US007578019B2

(12) United States Patent
La Belle et al.

(10) Patent No.: US 7,578,019 B2
(45) Date of Patent: Aug. 25, 2009

(54) METHOD FOR REPOSITIONING ARTICLES IN A WASHING MACHINE

(75) Inventors: Kathleen M. La Belle, Lawrence, MI (US); Kurt Werner, St. Joseph, MI (US); Pamela Smith, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 662 days.

(21) Appl. No.: 11/228,101

(22) Filed: Sep. 16, 2005

(65) Prior Publication Data

US 2007/0061981 A1 Mar. 22, 2007

(51) Int. Cl.
*D06F 35/00* (2006.01)

(52) U.S. Cl. ..... 8/159; 8/158

(58) Field of Classification Search ..... 8/158, 8/159

See application file for complete search history.

(56) References Cited

U.S. PATENT DOCUMENTS 4,813,248 A * 3/1989 Smith et al. ..... 68/23.7
6,212,722 B1 4/2001 Pinkowski et al. ..... 8/158
6,584,811 B2 * 7/2003 Whah et al. ..... 68/12.04
2004/0148710 A1 8/2004 Kim ..... 8/159

FOREIGN PATENT DOCUMENTS

EP 0631001 B1 * 8/1998
JP 6114189 4/1994

OTHER PUBLICATIONS

Daewoo Electronics Co., Ltd, "Daewoo Air Power Washer", 1996, 4 Pages.

* cited by examiner

*Primary Examiner*—Michael Barr
*Assistant Examiner*—Jason Y. Ko
(74) *Attorney, Agent, or Firm*—Clifton G. Green; McGarry Bair, P.C.

(57) ABSTRACT

An automatic clothes washer has a wash basket defining a wash chamber for receiving a clothes load and a clothes mover provided in the wash chamber for reciprocal rotation. The automatic clothes washer performs a laundering of a clothes load by wetting a portion of the clothes load to form a clothes load with both wetted and unwetted articles of clothes. The clothes load is then reoriented by moving at least some of the wetted articles of clothing into at least some of the unwetted articles of clothing.

26 Claims, 18 Drawing Sheets

METHOD FOR REPOSITIONING ARTICLES IN A WASHING MACHINE

BACKGROUND OF THE INVENTION

1. Field of the Invention

The present invention relates to a system for washing clothes in an automatic clothes washer and more particularly to a method for redistributing articles of clothing within the wash chamber of an automatic clothes washer from a generally horizontal orientation to a generally vertical orientation.

2. Description of the Related Art

Automatic clothes washers are a common household appliance. They typically comprise a perforated basket for holding garments, sheets, towels, and other fabric items, and an imperforate tub containing a wash liquid comprising water or a mixture of water and detergent. A clothes mover is coaxially mounted in the bottom of the basket and adapted for angular oscillation in order to agitate the garments. In one configuration, the basket, clothes mover, and tub are oriented about a vertical axis.

Traditionally, the vertical axis clothes mover can be configured as an impeller or an agitator, which can be in combination with an auger that extends along the vertical axis approximately the height of the tub. The impeller is typically a low-profile base element having a circular periphery, with vanes extending from the element. The agitator typically has a base from which extends a vertical post.

It is generally understood that a deep fill wash cycle refers to a cloth to water ratio that, when combined with the action of the clothes mover, produces fluid motion which significantly aids in the motion of the cloth even if the actual water level in the machine is not near the top of the wash basket. The garments are considered suspended in the free fluid, or submerged, when there is sufficient fluid power to directly result in movement of the garments.

Likewise a low fill wash cycle, also called a low water wash cycle, generally refers to a cloth to water ratio that, when combined with the action of the clothes mover, produces insufficient fluid motion to directly result in cloth motion regardless of the direction of fluid motion. In fact, the resulting cloth motion may still be present even if very little free fluid is present. In this process, a garment is not considered to be suspended or submerged in the free fluid even if the actual water level is near the top of the basket or near the top of the clothes load.

In a vertical axis clothes washer with a deep fill wash cycle where the clothes are completely submerged, reciprocal movement of an agitator moves the garments along a toroidal, or donut-shaped, path extending radially inwardly toward the center of the basket, downwardly along the vertical axis, radially outwardly toward the outer wall of the basket, and upwardly along the perimeter of the basket where they repeat the cycle. One full cycle along this path is commonly referred to as a "rollover." This movement, and the structure and operation of a vertical axis clothes washer, are described and illustrated in U.S. Pat. No. 6,212,722, which is fully incorporated by reference herein.

In a low water cycle, such as where the clothes are wetted but not submerged, the movement of the clothes by reciprocating the impeller moves the garments in an opposite direction than that of the agitator with a deep fill in what has been termed an "inverse toroidal rollover." This movement is also described and illustrated in U.S. Pat. No. 6,212,722.

When a clothes load is placed in a basket having a clothes mover that does not contain a center shaft or auger, such as with a low-profile impeller, the garments naturally form multiple, generally horizontal layers. Each garment tends to spread out into a thin layer as it is placed in the basket. This produces a load that is interlayered with the layers extending over the center of the basket and the impeller. When the impeller is oscillated to move the load in a toroidal or inverse toroidal direction, the portion of the clothes load being urged along the center of the basket to either the inside or outside of the impeller must work its way through the multiple horizontal layers. It can take a substantial period of time to reorient a clothes load so that it can efficiently move in a toroidal or inverse toroidal direction. This may comprise a significant portion of the wash cycle, which may result in inadequate washing of the garments due to the impediment to optimal movement.

It would be desirable to have a vertical axis automatic clothes washer that can be operated to optimize the reorientation of the garments in order to facilitate the garment movement necessary for effective washing of the garments.

SUMMARY OF THE INVENTION

An automatic clothes washer comprises a wash basket defining a wash chamber for receiving a clothes load and a clothes mover provided in the wash chamber for reciprocal rotation. A method for washing articles of clothing forming the clothes load comprises introducing a first volume of wash liquid into a pre-selected region of the wash chamber sufficient to locally wet a portion of a clothes load placed in the wash chamber, rotating the clothes mover for reorientation of a clothes load, introducing a second volume of wash liquid into the wash chamber sufficient to saturate a clothes load, and rotating the clothes mover for washing of a clothes load. This step may be preceded by a step comprising oscillating the clothes mover or spinning the wash basket in order to estimate a dry load weight of the clothes load.

The second volume of wash liquid is greater than the first volume of wash liquid, but less than a volume of wash liquid sufficient to completely submerge a clothes load. Rotating the clothes mover for reorientation of a clothes load comprises reciprocal rotation of the clothes mover, or an impeller.

Locally wetting a portion of a clothes load comprises wetting a portion of a clothes load occupying no more than half the wash chamber, or no more than one quarter of the wash chamber. Locally wetting a portion of a clothes load comprises wetting a portion of a clothes load while the clothes load is stationary, or while the wash basket is stationary.

Introducing a first volume of wash liquid into a pre-selected region of the wash chamber comprises introducing wash liquid from a stationary wash liquid inlet. Reorienting the clothes load comprises reciprocal rotation of a clothes mover.

Alternatively, a method for washing articles of clothing forming a clothes load in an automatic clothes washer comprising a wash basket defining a wash chamber for receiving the clothes load and a clothes mover provided in the wash chamber for reciprocal rotation, the method comprises wetting a portion of the clothes load to form a clothes load with both wetted and unwetted articles of clothes, and reorienting the clothes load by moving the wetted articles of clothing into the unwetted articles of clothing.

DESCRIPTION OF AN EMBODIMENT OF THE INVENTION

The invention described and illustrated herein relates to a vertical axis automatic clothes washer having a clothes mover that is operated to optimize an inverse toroidal rollover motion to garments and other fabric items, such as sheets, towels, rugs and the like, contained therein (hereinafter referred to collectively as "garments") during a laundering cycle. The garments will be described herein with respect to varying degrees of "wetness" at preselected times during a laundering cycle. These degrees include "wetting" or "wetted", which refers to a garment having a moisture content less than that required to saturate the garment, "saturated", which refers to the garment having a moisture content beyond which the garment cannot absorb any more liquid, and "submerged", which refers to the garment being immersed in a volume of liquid greater than that required to saturate the garment and the movement of the garment is significantly aided by fluid power.

To summarize the process described hereinafter, with a clothes basket held stationary, fresh wash liquid is applied to a portion of a clothes load located directly beneath a wash liquid inlet. After a selected volume of wash liquid is added sufficient to wet the garments directly beneath the fluid inlet, but insufficient to saturate the entire clothes load, oscillation of the clothes mover is initiated. Because a portion of the load is wet, and a portion of the load is dry, forces between the load and the clothes mover are unequal, which causes unequal movement of the wet and dry garments. This causes the dry garments to redistribute from a generally horizontal to a generally vertical orientation, thereby enabling garments to more readily move upwardly along the center axis of the clothes mover and basket.

Figure 1:
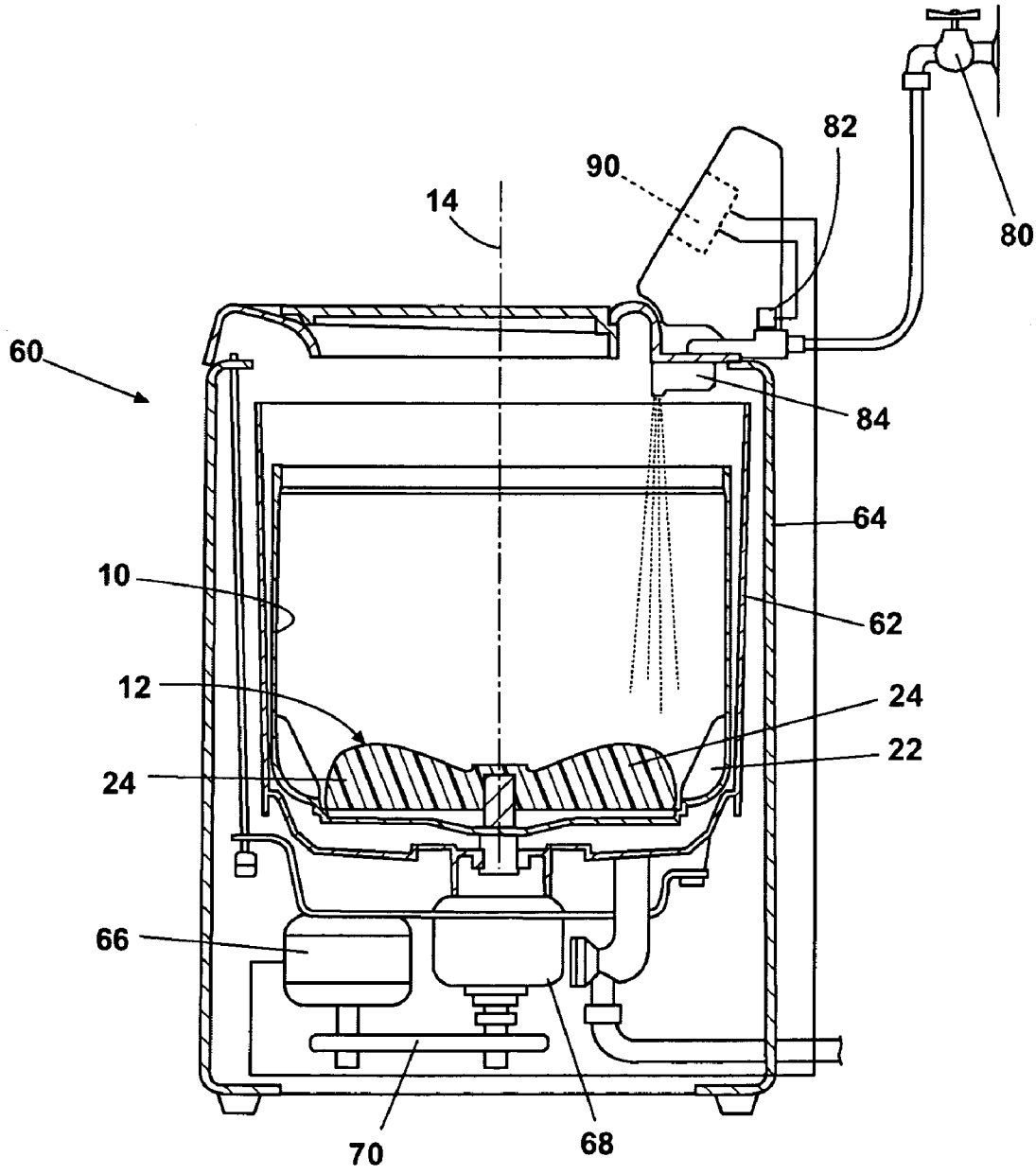
FIG. 1 is a partial cutaway view of an automatic clothes washing machine comprising a clothes mover according to the invention.

Referring to the Figures and to FIG. 1 in particular, an embodiment of the invention is illustrated comprising an automatic clothes washer 60 having a vertical axis clothes mover in the form of an impeller 12. The automatic clothes washer 60 shares many elements of a well-known clothes washer, and such elements will not be described in detail herein except as necessary for a complete understanding of the invention.

The automatic clothes washer 60 comprises a watertight tub 62 installed in a cabinet 64. A perforated wash basket 10 is mounted in the tub 62 for rotation about a central, vertical axis of rotation 14 extending through the center 16 of the impeller 12. A drive motor 66 operating a transmission 68 through a drive belt 70 is utilized to rotate the wash basket 10 and oscillate the impeller 12. The clothes washer 60 is fluidly connected to a water supply 80 through a valve assembly 82 which can be operated to selectively deliver water to the tub 62 through an outlet 84 positioned at one side of the wash tub 62. A control panel 90 enables the operator to control the operation of the clothes washer 60.

Figure 2:
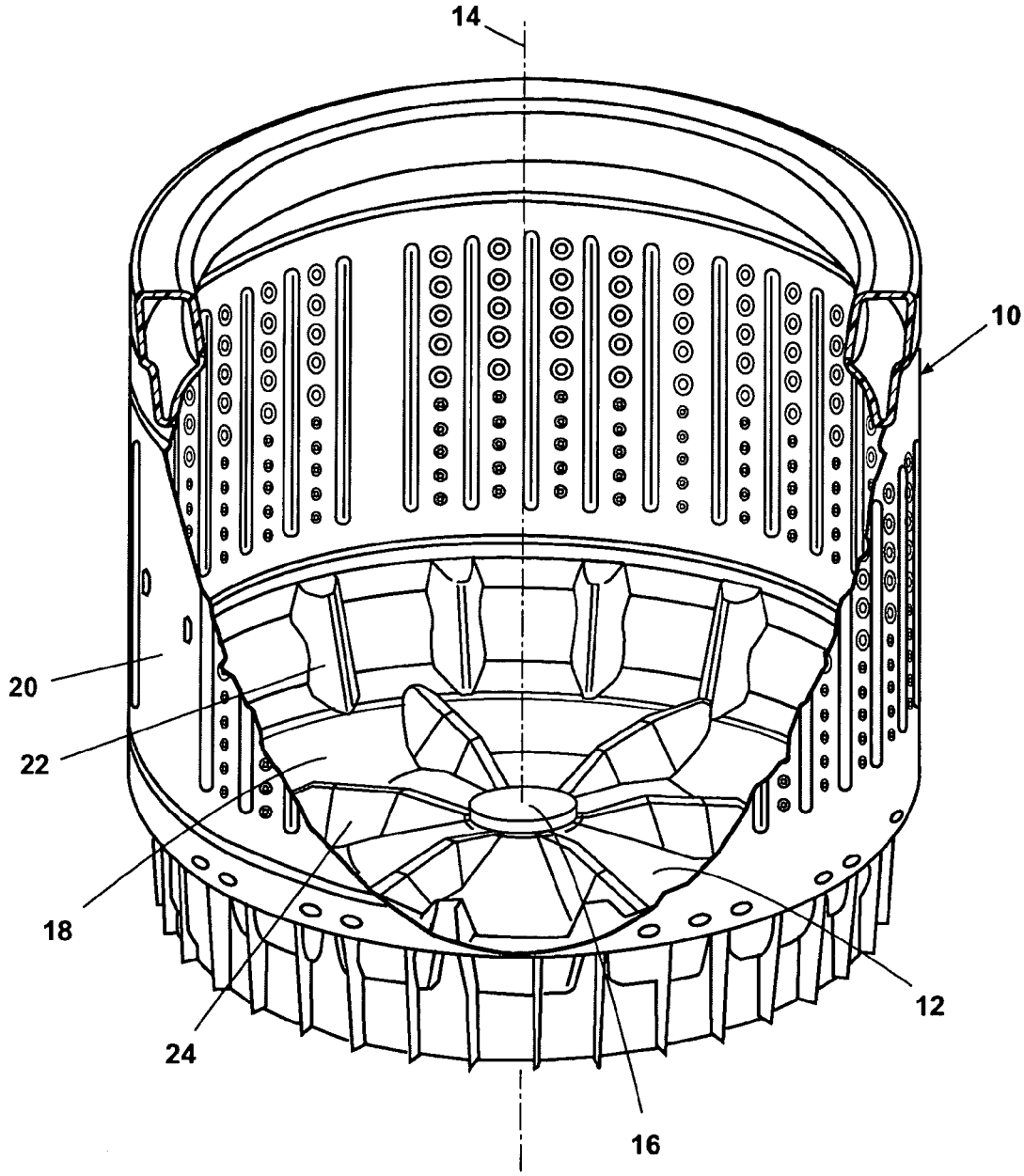
FIG. 2 is a partial cutaway view illustrating the interior of a vertical axis wash basket having a clothes mover for an automatic clothes washer.

Referring also to FIG. 2, the wash basket 10 and the impeller 12 together define an axis of rotation 14 extending through the center 16 of the impeller 12. The impeller 12 is positioned above the floor of the basket 10 and is rotated by a drive shaft extending through an opening in the floor of the basket 10. The impeller terminates in a peripheral edge prior to reaching a sidewall 20 of the basket to expose a portion of a bottom wall 18 of the basket therebetween. A plurality of regularly-spaced fixed vanes 22 extend from the bottom wall 18 and sidewall 20 and extend radially inwardly from the sidewall 20.

The impeller 12 is provided with a plurality of regularly-spaced vanes 24 extending radially away from the center 16. The vanes 24 are illustrated in FIG. 2 as paddle-like, although other vane configurations can be utilized. The impeller 12 is adapted for oscillating rotation about the vertical axis 14 relative to the basket rim 18.

Figure 3:
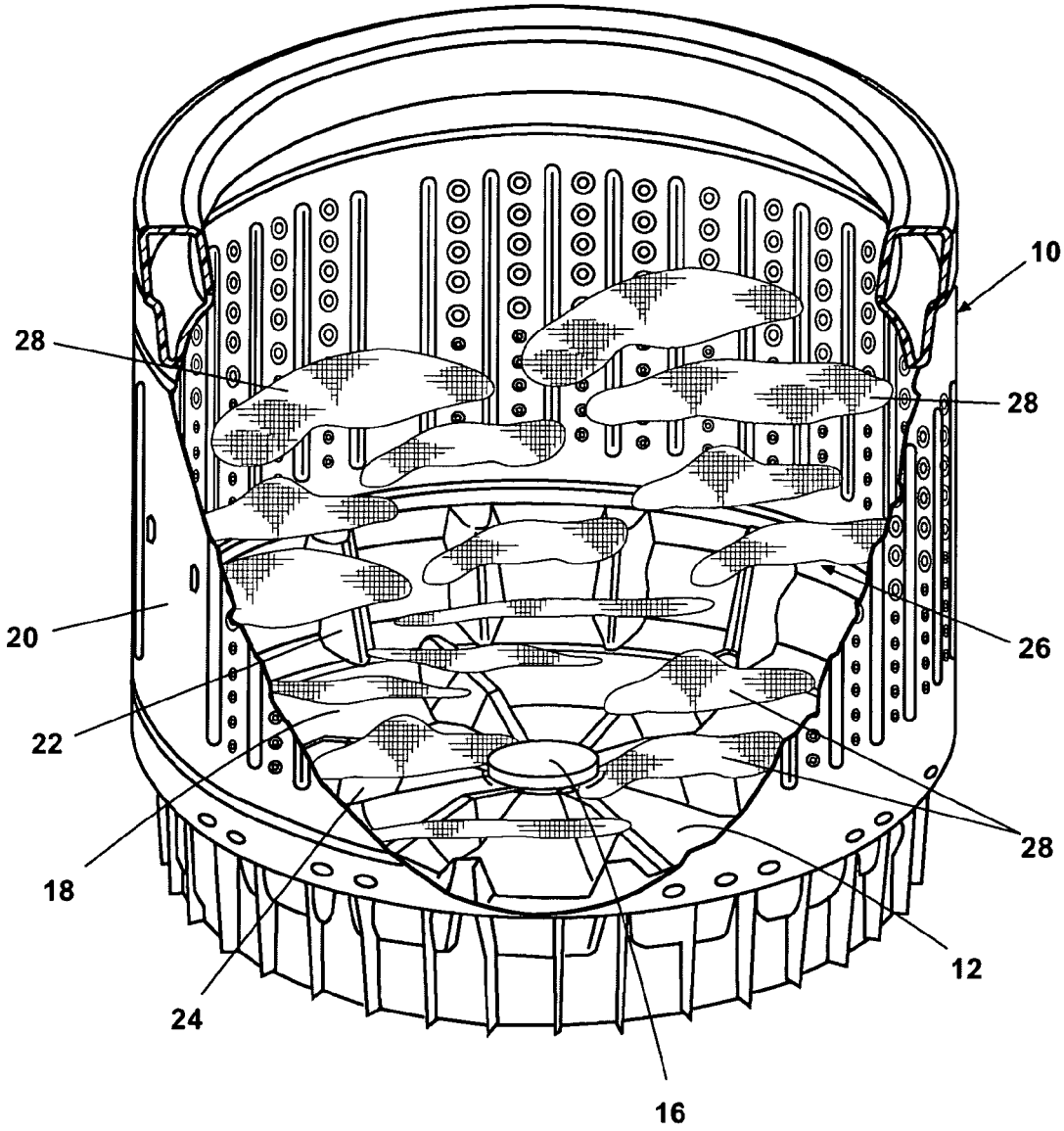
FIG. 3 is a partial cutaway view of the vertical axis wash basket of FIG. 2 illustrating a clothes load occupying the interior of the wash basket comprising a plurality of garments in a generally horizontally interlayered orientation.

FIG. 3 illustrates schematically a clothes load 26 placed in the wash basket 10 comprising a plurality of garments 28 distributed in a generally horizontally interlayered configuration above the impeller 12 and the rim 18. The garments 28 are thus randomly interlayered, or "cross-linked," throughout the depth of the clothes load 26, thereby minimizing the presence of vertical passageways through the clothes load 26. The spacing between the garments 28 is exaggerated to better illustrate the concept.

Figure 4:
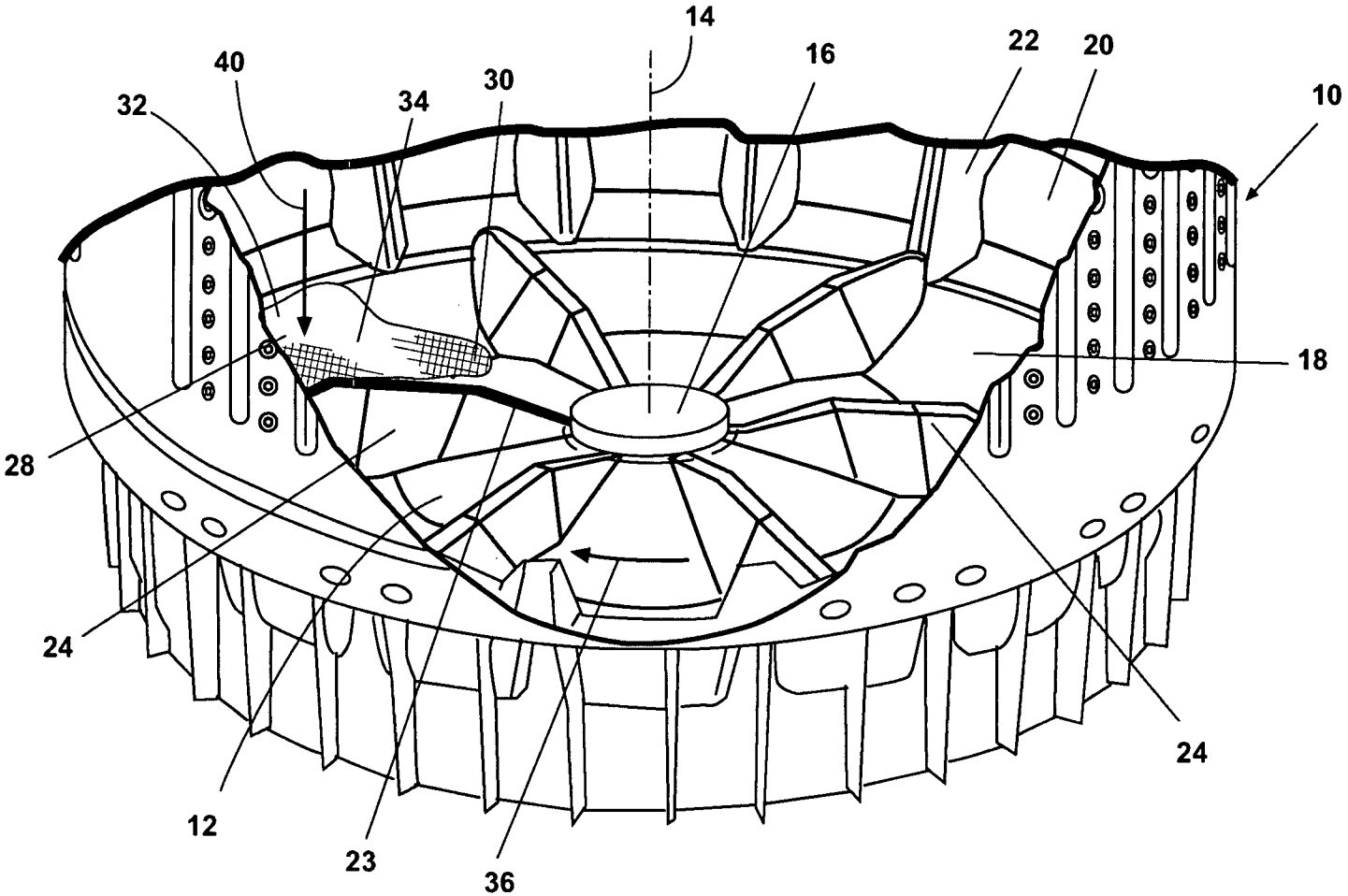
FIG. 4 is an enlarged cutaway view of the vertical axis wash basket and clothes mover of FIG. 2 illustrating a first configuration of a garment during an inverse toroidal rollover motion due to rotational movement of the clothes mover.

As illustrated in FIG. 4, a garment 28 at the bottom of the clothes load 26 will have a proximal end 30 resting on the impeller 12, a distal end 32 resting on the basket rim 18, and a center portion 34 intermediate the ends 30, 32 and resting partly on the impeller 12 and partly on the basket rim 18. The garment 28 will be held in place by the weight of garments above it, represented by the load vector 40, and by the basket wall 20. The garment 28 is illustrated as partly engaging an impeller vane 24, identified with a heavy line along its upper edge 23. As the impeller 12 rotates, represented by the clockwise rotation vector 36, the proximal end 30 will be circumferentially moved by the angular displacement of the vane 24. However, the distal end 32 will be retained on the basket rim 18, primarily by the weight of the overlying garments.

Figure 5:
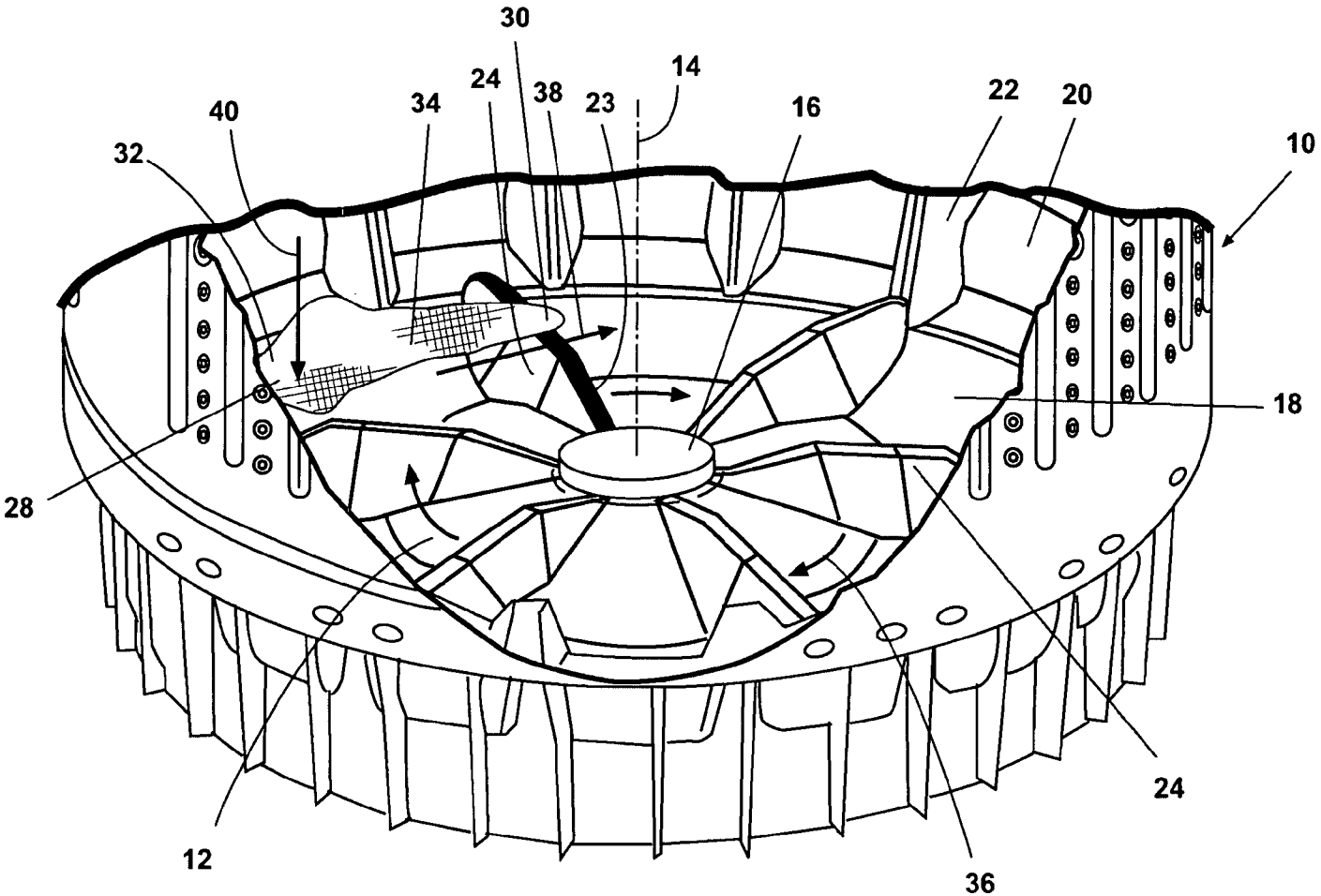
FIG. 5 is an enlarged cutaway view of the vertical axis wash basket and clothes mover of FIG. 4 illustrating a second configuration of the garment during an inverse toroidal rollover motion due to rotational movement of the clothes mover.

Referring now to FIG. 5, as the vane 24 continues to move, the proximal end 30 moves with the vane 24, thereby stretching a portion of the garment 28. The distal end 32 will continue to be held on the basket rim 18, thereby resulting in the garment 28 being elongated in the direction of the drag vector 38.

Figure 6:
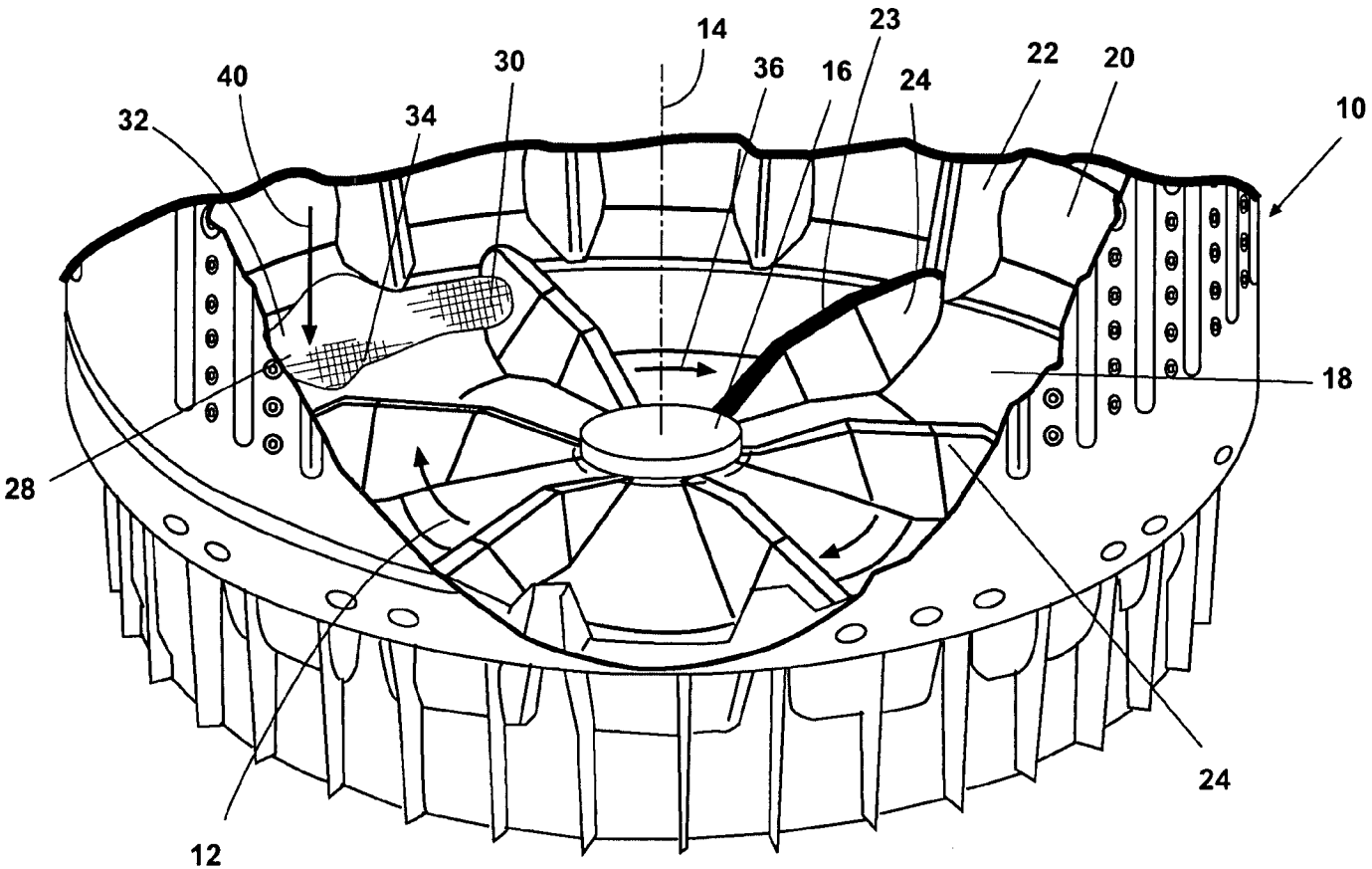
FIG. 6 is an enlarged cutaway view of the vertical axis wash basket and clothes mover of FIG. 4 illustrating a third configuration of the garment during an inverse toroidal rollover motion due to rotational movement of the clothes mover.

As illustrated in FIG. 6, as the impeller 12 continues to rotate, at some angular displacement, the vane 24 will separate from the proximal end 30 of the garment 28, which will remain in an elongated configuration with the distal end 32 engaging the rim 18.

Figure 7:
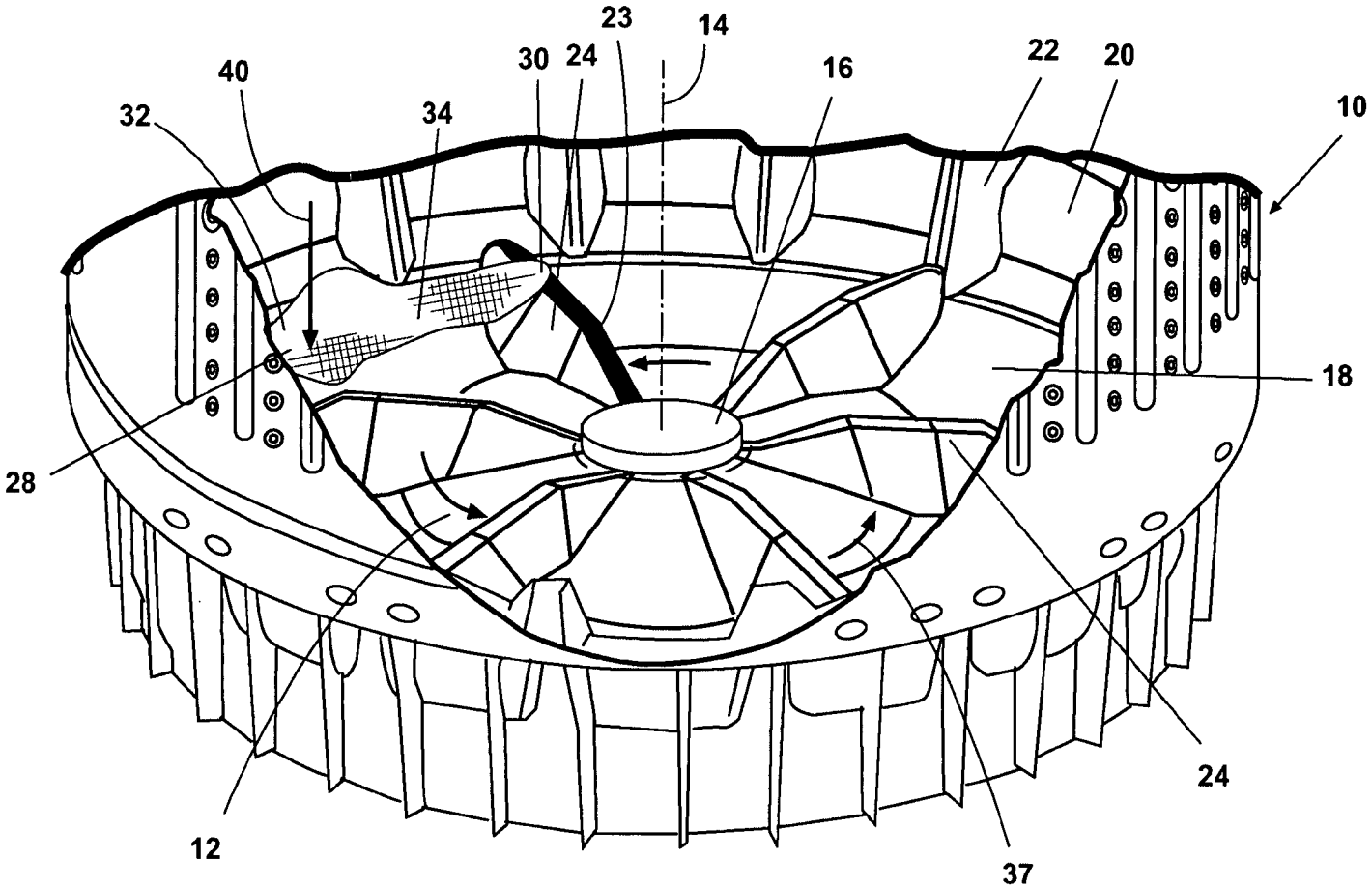
FIG. 7 is an enlarged cutaway view of the vertical axis wash basket and clothes mover of FIG. 4 illustrating a fourth configuration of the garment during an inverse toroidal rollover motion due to rotational movement of the clothes mover.
Figure 8:
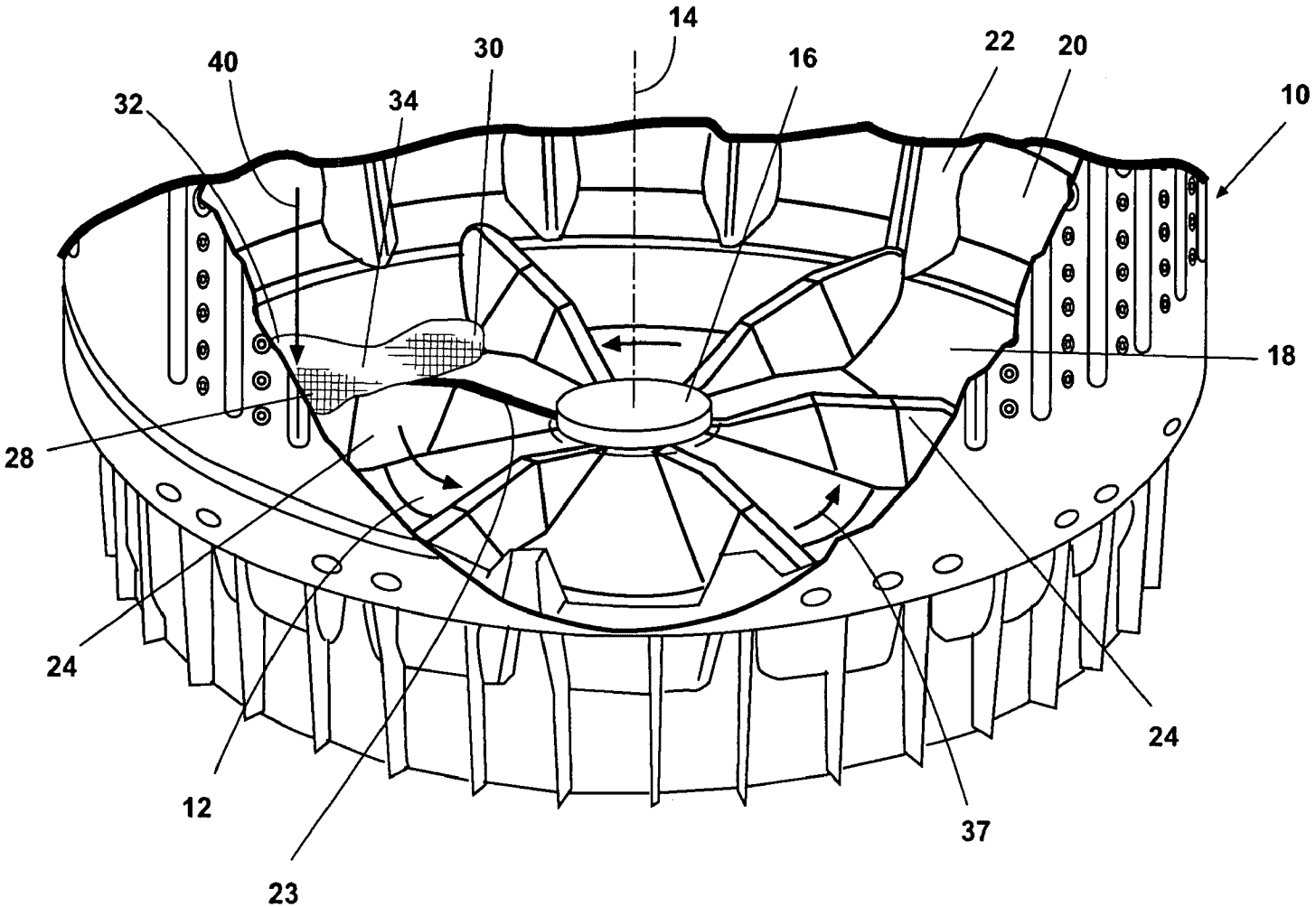
FIG. 8 is an enlarged cutaway view of the vertical axis wash basket and clothes mover of FIG. 4 illustrating a fifth configuration of the garment during an inverse toroidal rollover motion due to rotational movement of the clothes mover.

At some point, the impeller 12 will stop, and will then rotate in a counterclockwise direction. Referring to FIG. 7, when the impeller 12 is rotated in a counterclockwise direction, as illustrated by the rotation vector 37, the blade 24 will rotate to a position beneath the proximal end 30 and will engage the garment 28 in an area toward the center portion 34 from the proximal end 30. As illustrated in FIG. 8, the center portion 34 of the garment 28 will then be displaced circumferentially by the counterclockwise angular displacement of the vane 24. This causes the center portion 34 of the garment 28 to be translated toward the center 16.

Continued counterclockwise rotation of the impeller 12 will again stretch the garment 28 and, at some angular displacement, the garment 28 will separate from the vane 24. This will be followed by stopping of the impeller 12 and the initiation of another clockwise rotation. Again, the vane 24 will rotate beneath and engage the garment 28 further toward the center portion 34, and the process will be repeated. This process will gradually move the garment 28 toward the center 16 of the impeller 12.

The above process has been described with respect to a single garment 28. However, in actuality, the process involves numerous garments distributed around the outer portion of the impeller 12 and the basket rim 18. Thus, a number of garments will move simultaneously toward the center 16 of the impeller 12, and will be urged upwardly along the vertical axis 14 since there will be no other direction in which the garments can travel. Because of the generally horizontally interlayered distribution of the garments over the impeller 12, upward movement of the garments along the vertical axis 14 will be obstructed, since the overlying garments will form a barrier. The garments can only move upwardly through channels between the overlying garments, which must be selectively provided.

Figure 9:
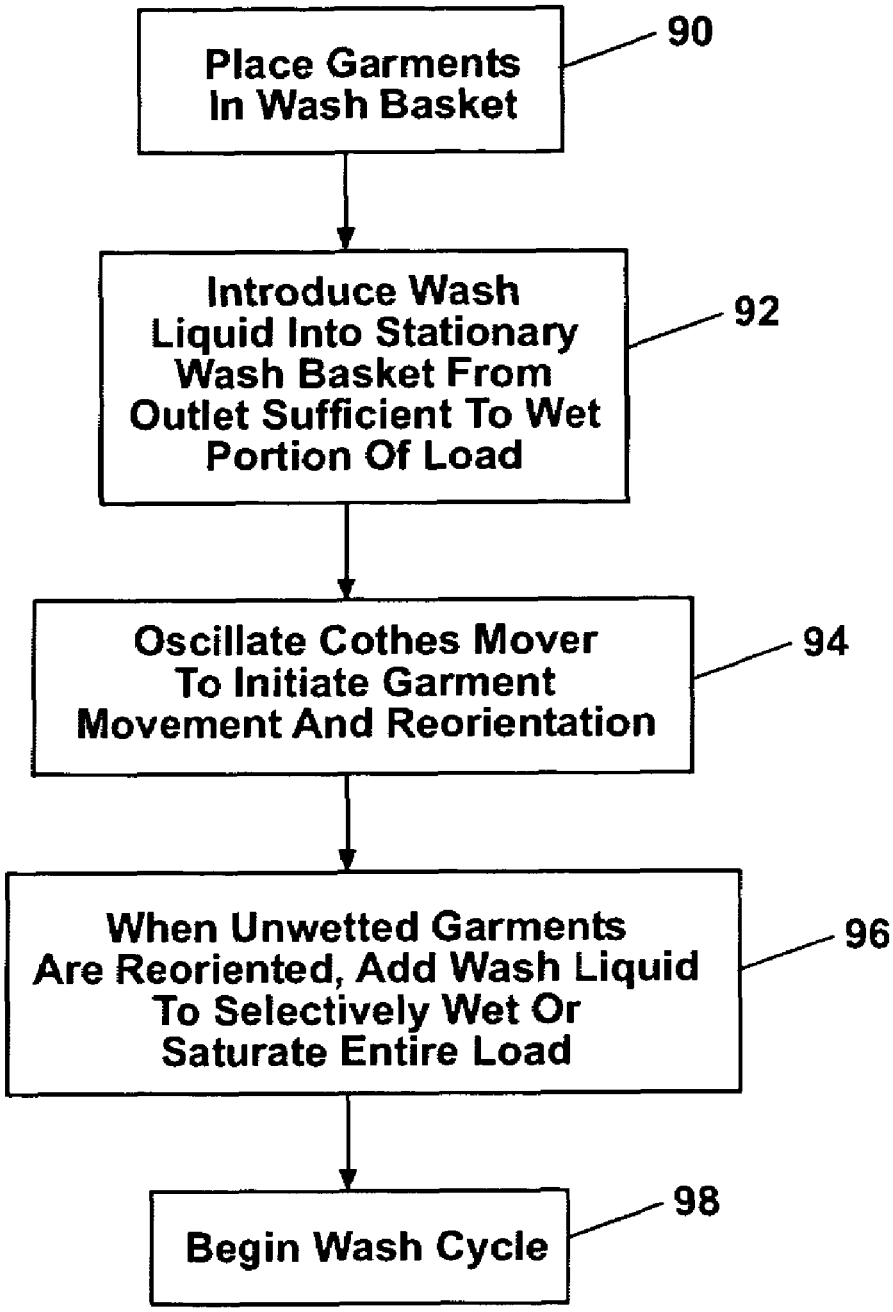
FIG. 9 is a flow diagram of a method of reorienting garments in the wash basket according to the invention.

FIG. 9 illustrates steps in the inventive method of reorienting the garments to facilitate the initiation of reverse toroidal flow, which is described in greater detail hereinafter. In a first step 90, the garments are placed in the wash basket 10. In a second step 92, wash liquid is then introduced to wet a portion of the load. This second step may be preceded by a step comprising either oscillating the clothes mover or spinning the wash basket in order to estimate a dry load weight of the clothes load.

The impeller 12 is then oscillated in a third step 94 until the unwetted clothes are reoriented from a horizontal to a vertical orientation. Wash liquid is then added in a fourth step 96 to wet or saturate the entire load, and the wash cycle is then initiated in a fifth step.

Figure 10:
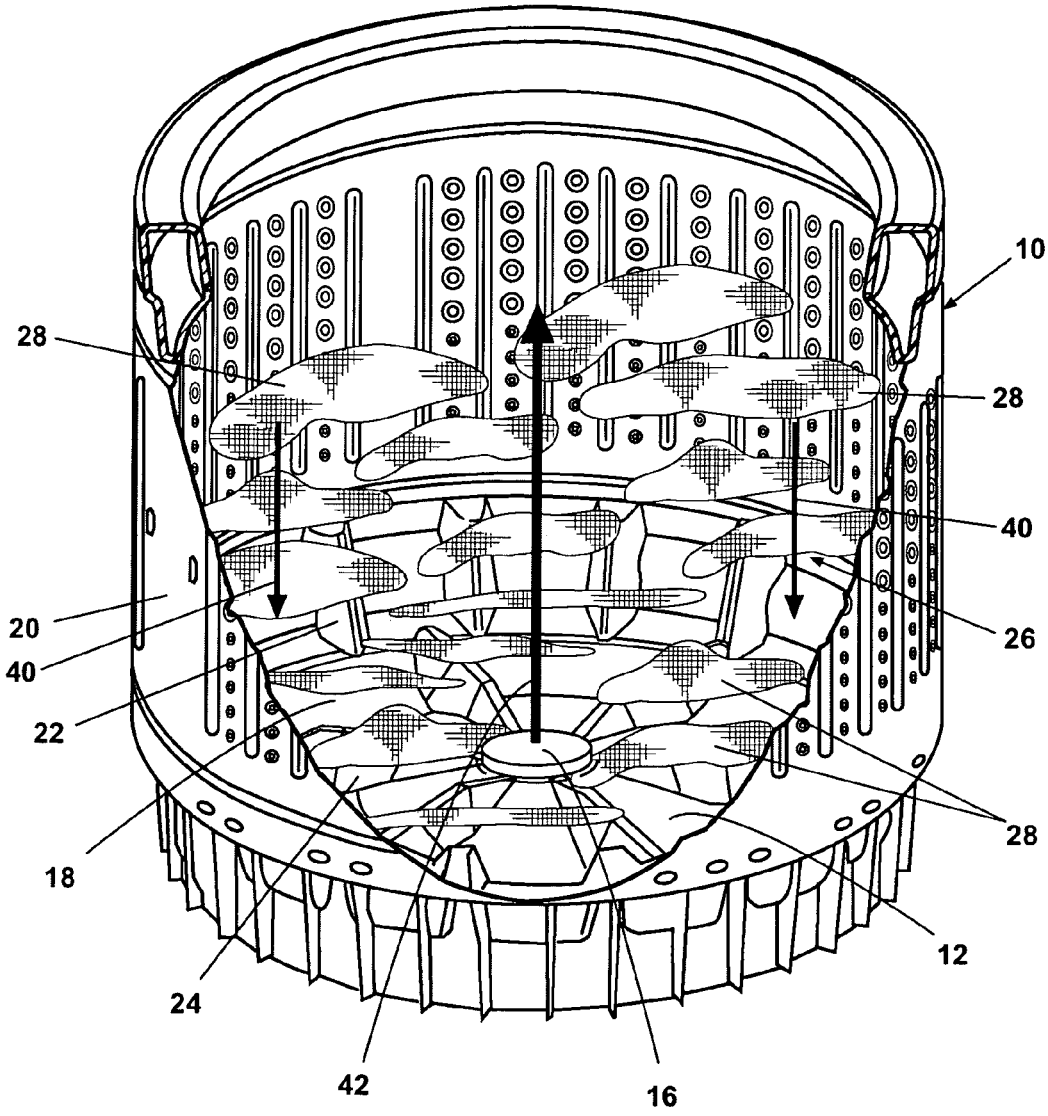
FIG. 10 is a partial cutaway view of the vertical axis wash basket of FIG. 2 illustrating the movement of the garments comprising the clothes load downwardly along a periphery of the wash basket and upwardly through the horizontally interlayered garments at the center of the wash basket.

Referring now to FIG. 10, when the wash basket 10 is very full, the clothes load 26 forms many layers across the center of the wash basket 10 through which the underlying garments 28 must move. The overlying layers exert a downward force, represented by the load vectors 40, on the garments 28 in contact with the impeller 12 and the basket rim 18. As previously described, this layering impedes the upward movement of the garments 28, represented by the displacement vector 42, along the centerline of the wash basket 10. In order to facilitate this upward movement, a portion of the clothes load 26 is wetted prior to the initiation of the wash cycle.

Figure 11:
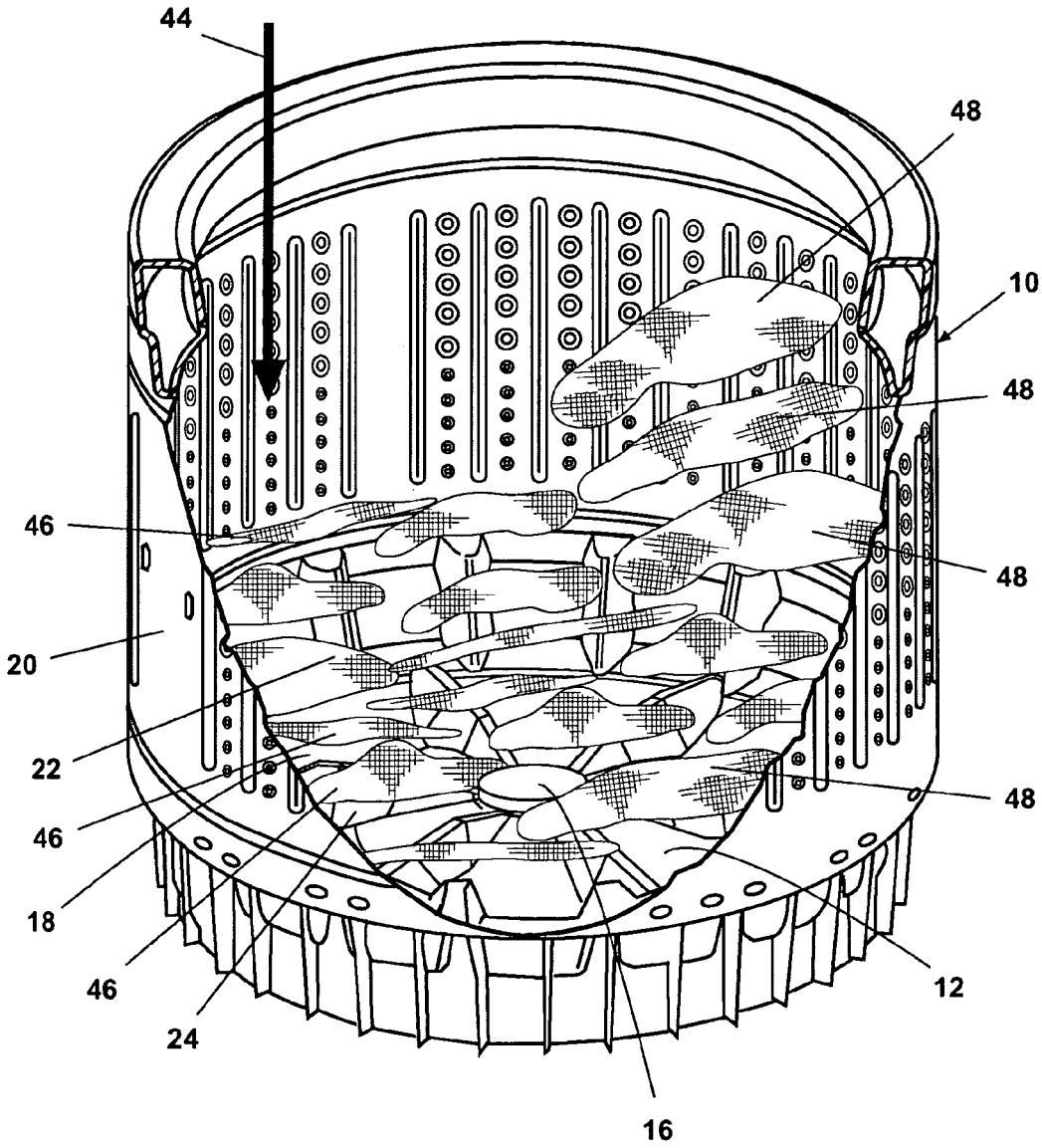
FIG. 11 is a partial cutaway view of a vertical axis wash basket illustrating a clothes load occupying the interior of the wash basket comprising a plurality of garments in a generally horizontally interlayered orientation during a first step in reorienting the garments according to the invention.

Referring now to FIG. 11, after the garments 28 have been placed in the wash basket 10, a selected volume of wash liquid less than the volume required to saturate the clothes load 26 is introduced into the wash basket 10 through the wash liquid outlet 84 while the wash basket 10 and the impeller 12 remain stationary. Thus, only a portion of the clothes load 26 is wetted. This portion can range from approximately one half the clothes load 26 to less than one quarter of the clothes load 26. The wetted garments can be located on one side of the basket. The wetted garments 46 are compressed by the weight of the wash liquid and overlying wetted garments 46. The wetted garments 46 are illustrated in FIG. 11 as compressed along the left side of the figure. This imposes a load on the wetted garments 46 in contact with the impeller 12 and the basket rim 18 which is much higher than the load imposed by the garments in an unwetted condition. Since the unwetted garments 48 are lighter than the wetted garments 46, an uneven weight distribution is created throughout the clothes load 26. This is in contrast to an initially unwetted load, wherein there is no appreciable difference in the loading of the garments throughout the clothes load 26.

Figure 12:
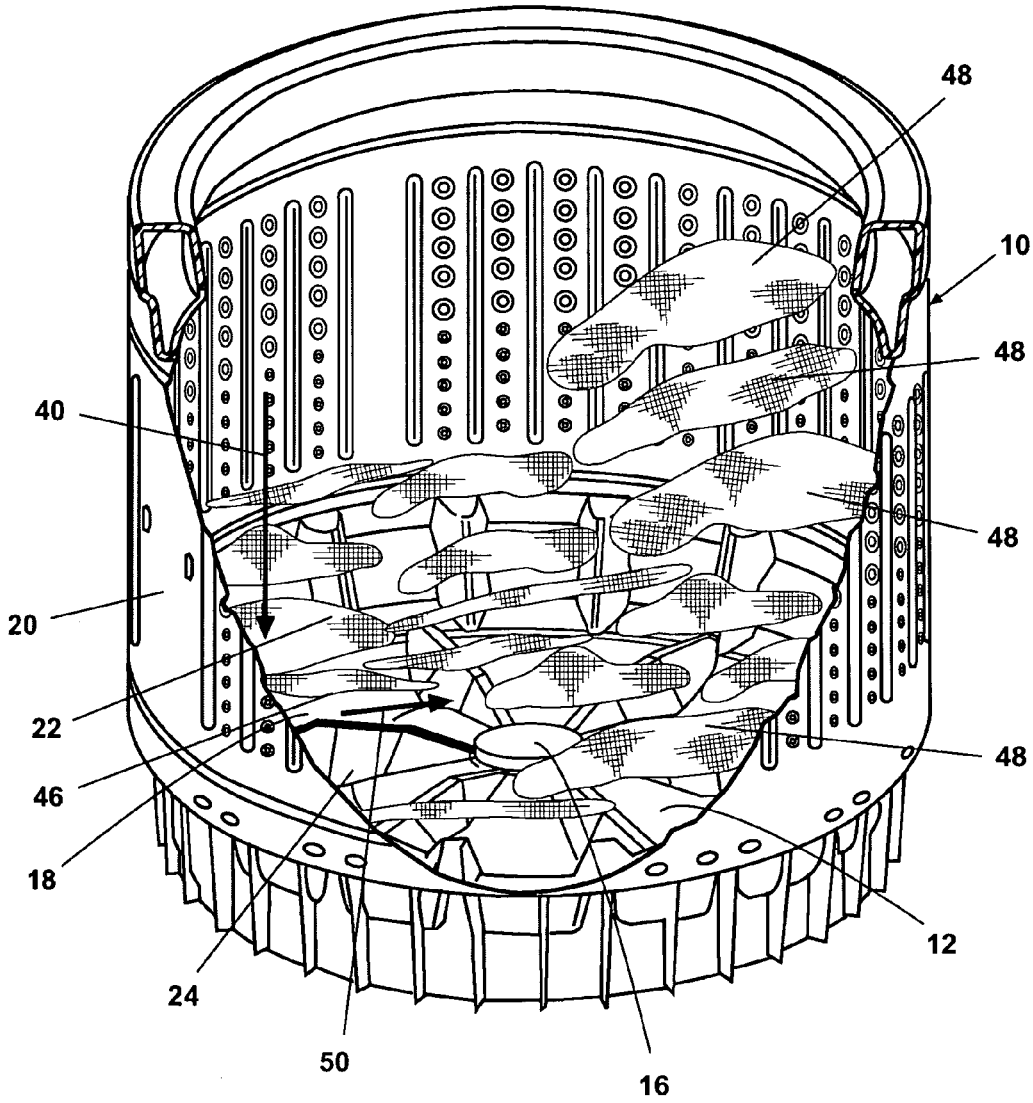
FIG. 12 is a partial cutaway view of the vertical axis wash basket of FIG. 10 illustrating a second step in reorienting the garments according to the invention.
Figure 13:
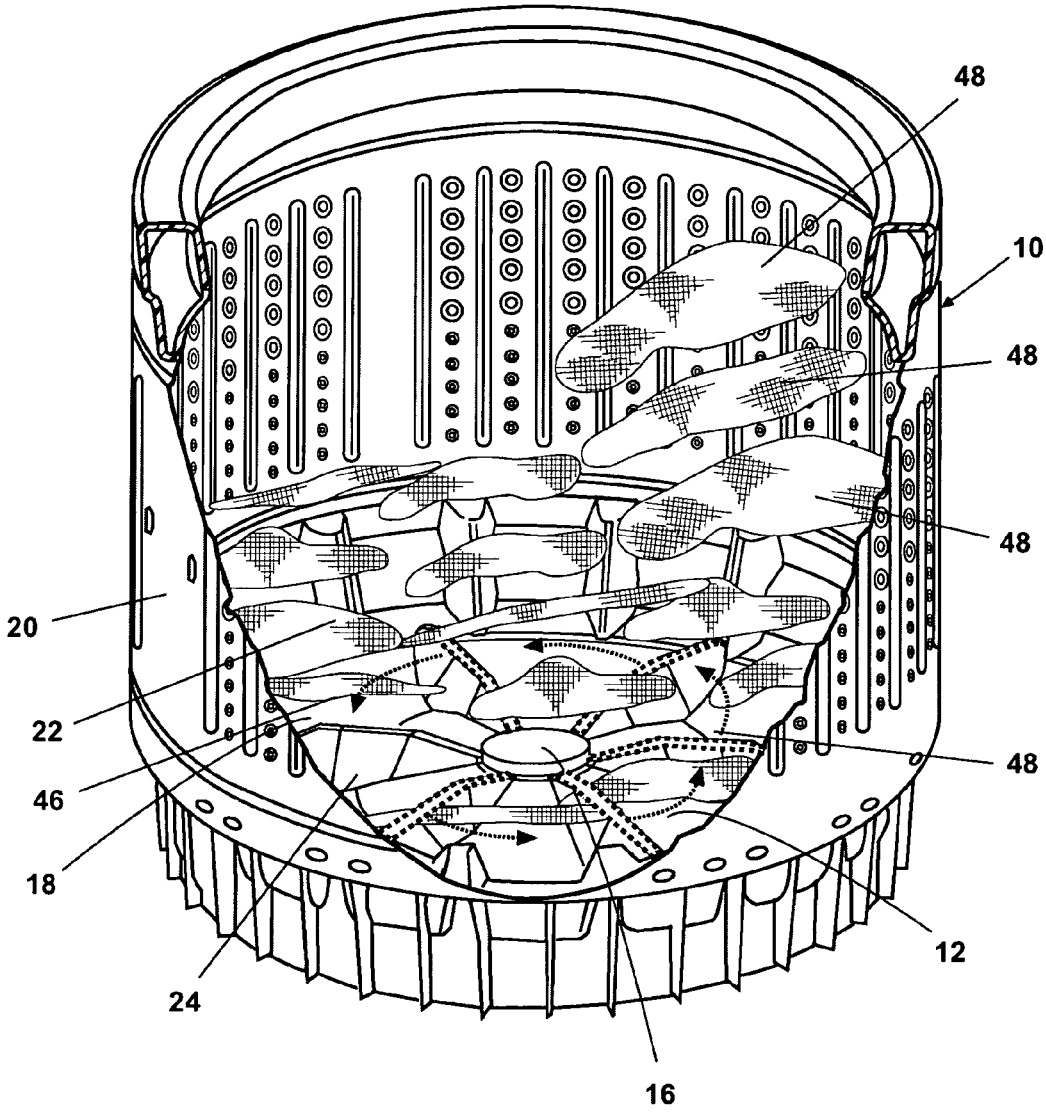
FIG. 13 is a partial cutaway view of the vertical axis wash basket of FIG. 10 illustrating a third step in reorienting the garments according to the invention.
Figure 14:
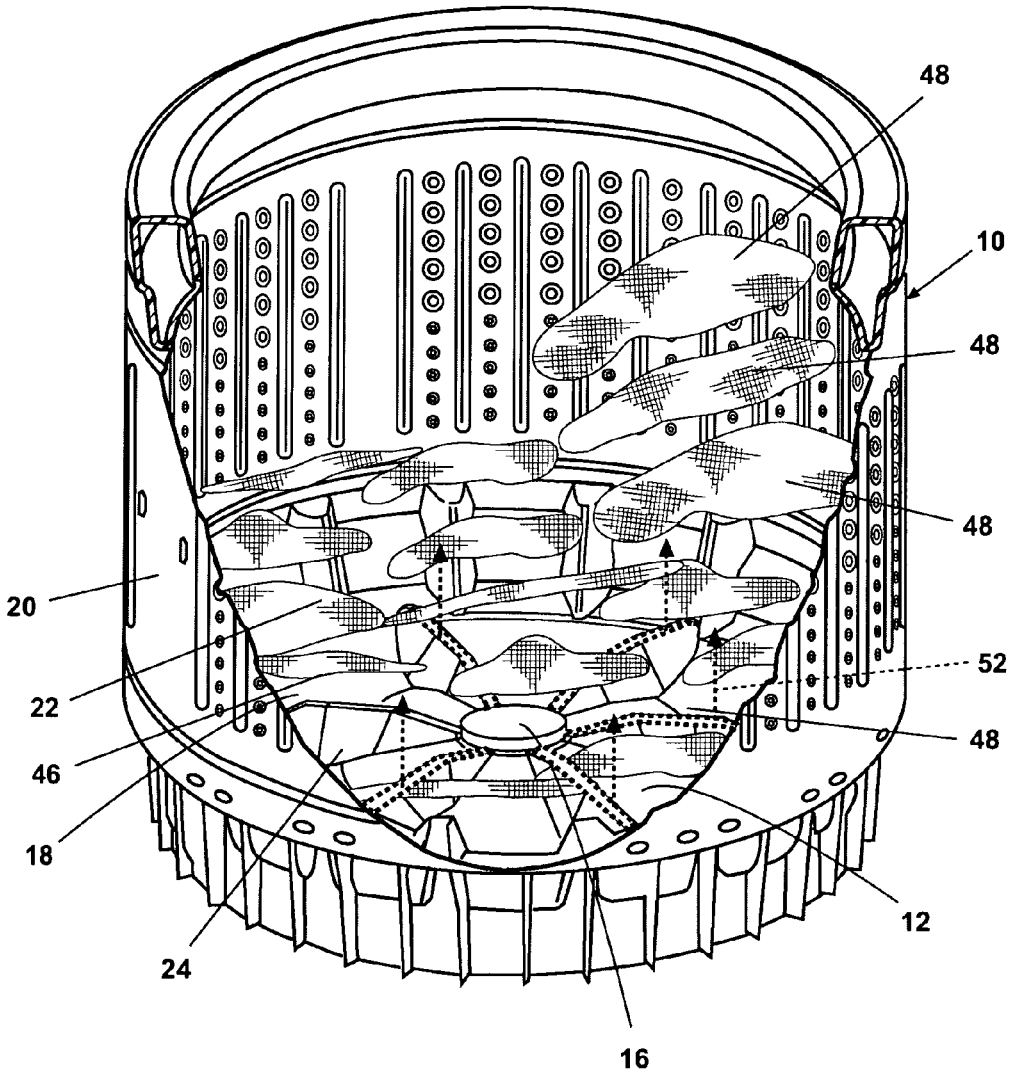
FIG. 14 is a partial cutaway view of the vertical axis wash basket of FIG. 10 illustrating a fourth step in reorienting the garments according to the invention.

As illustrated in FIG. 12, the impeller 12 is rotated. As the impeller 12 is rotated, the wetted garments 46 are pulled beneath the overlying wetted garments 46 as previously described herein, with overlying garments gradually pulled downwardly along the basket wall 20. However, due to the lower weight load imposed by the unwetted garments 48 on the underlying vanes 24, illustrated in FIG. 13 with a dotted line along their upper edge, the unwetted garments 48 are not effectively moved during the rotation of the impeller 12. Whatever movement of the unwetted garments 48 occurs is limited as the vanes 24 rotate away from the garments 48. Additionally, the unwetted garments 48 are relatively light and uncompressed, giving them a tendency to "bounce" on the vanes 24. This additionally provides an upward momentum on the unwetted portion of the clothes load 26, as illustrated in FIG. 14 by the "bounce" vectors 52.

Figure 15:
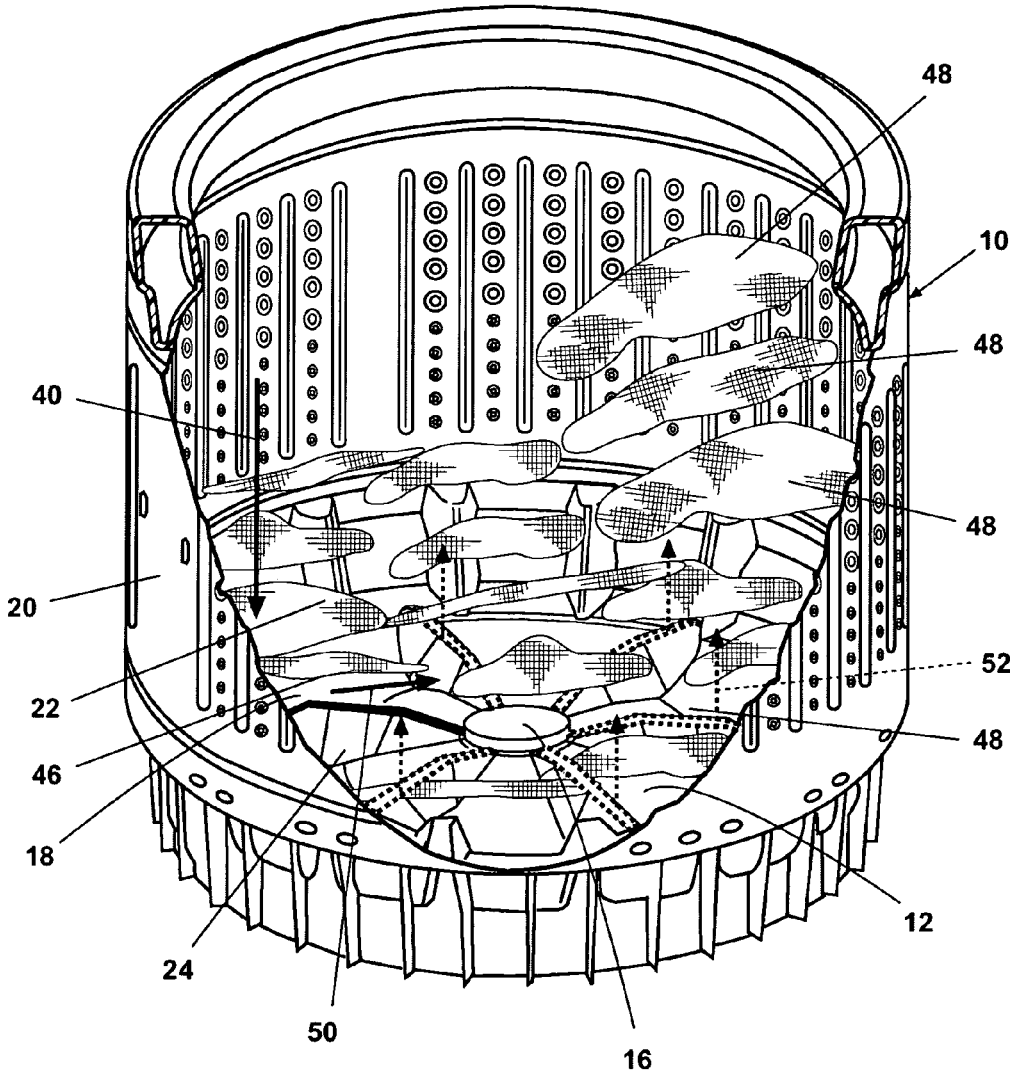
FIG. 15 is a partial cutaway view of the vertical axis wash basket of FIG. 10 illustrating a fifth step in reorienting the garments according to the invention.
Figure 16:
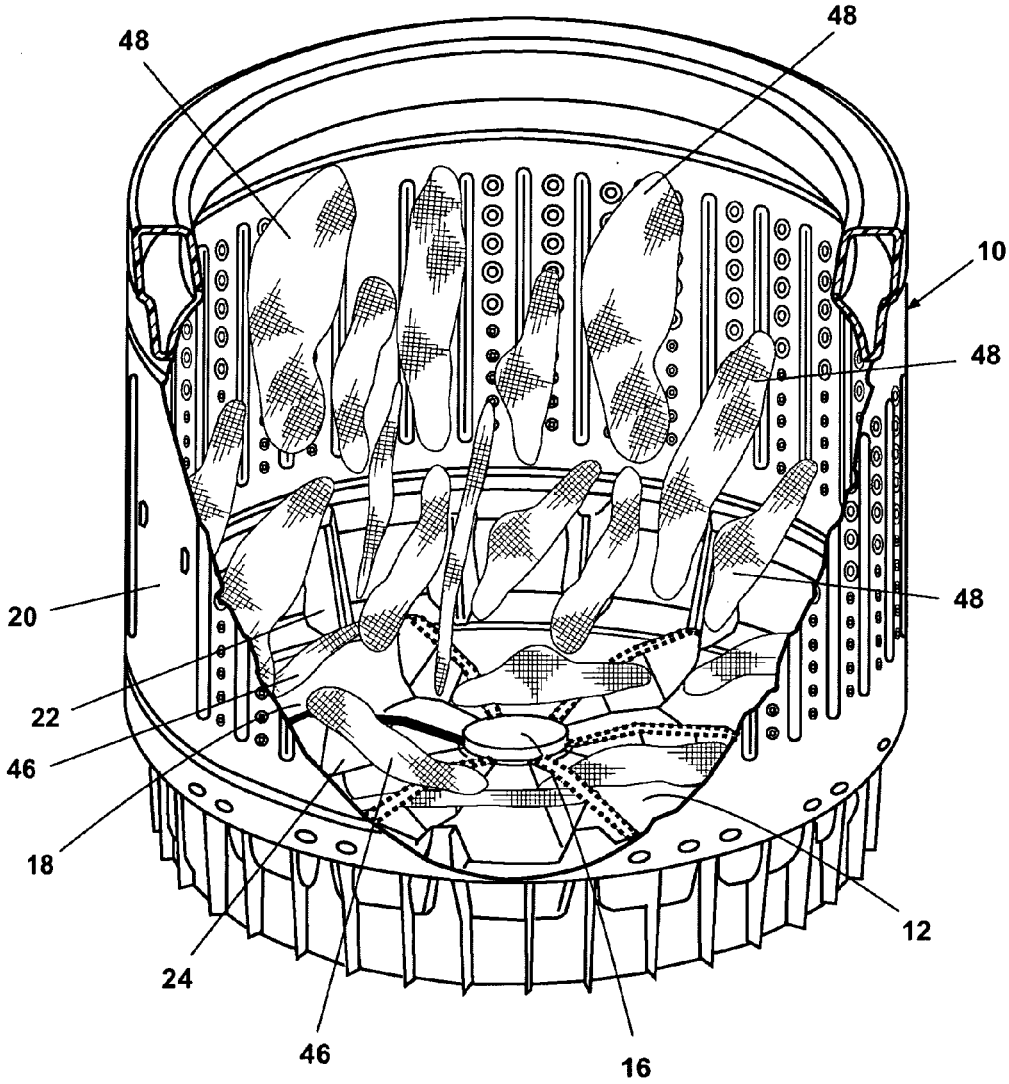
FIG. 16 is a partial cutaway view of the vertical axis wash basket of FIG. 10 illustrating a sixth step in reorienting the garments according to the invention.

Referring now to FIG. 15, the combination of the movement of the wetted garments 46 beneath the rest of the clothes load 26, the upward movement of the garments 48 in the dry portion of the clothes load 26, and the compression of the wetted garments 46, the clothes load 26 has a tendency to "flip." As illustrated in FIG. 16, as the impeller 12 oscillates, the unwetted garments 48 reorient to a generally vertical orientation and fan out above the wetted garments 46. The vertical orientation of the garments enables underlying garments at the center 16 of the impeller 12 to move upwardly along the axis of rotation 14 between the vertically-oriented garments, which cannot be readily accomplished with the overlying garments in the horizontally interlayered orientation. As garments move upwardly along the axis of rotation 14, additional garments can move radially-inwardly toward the center 16 as previously described.

Figure 17:
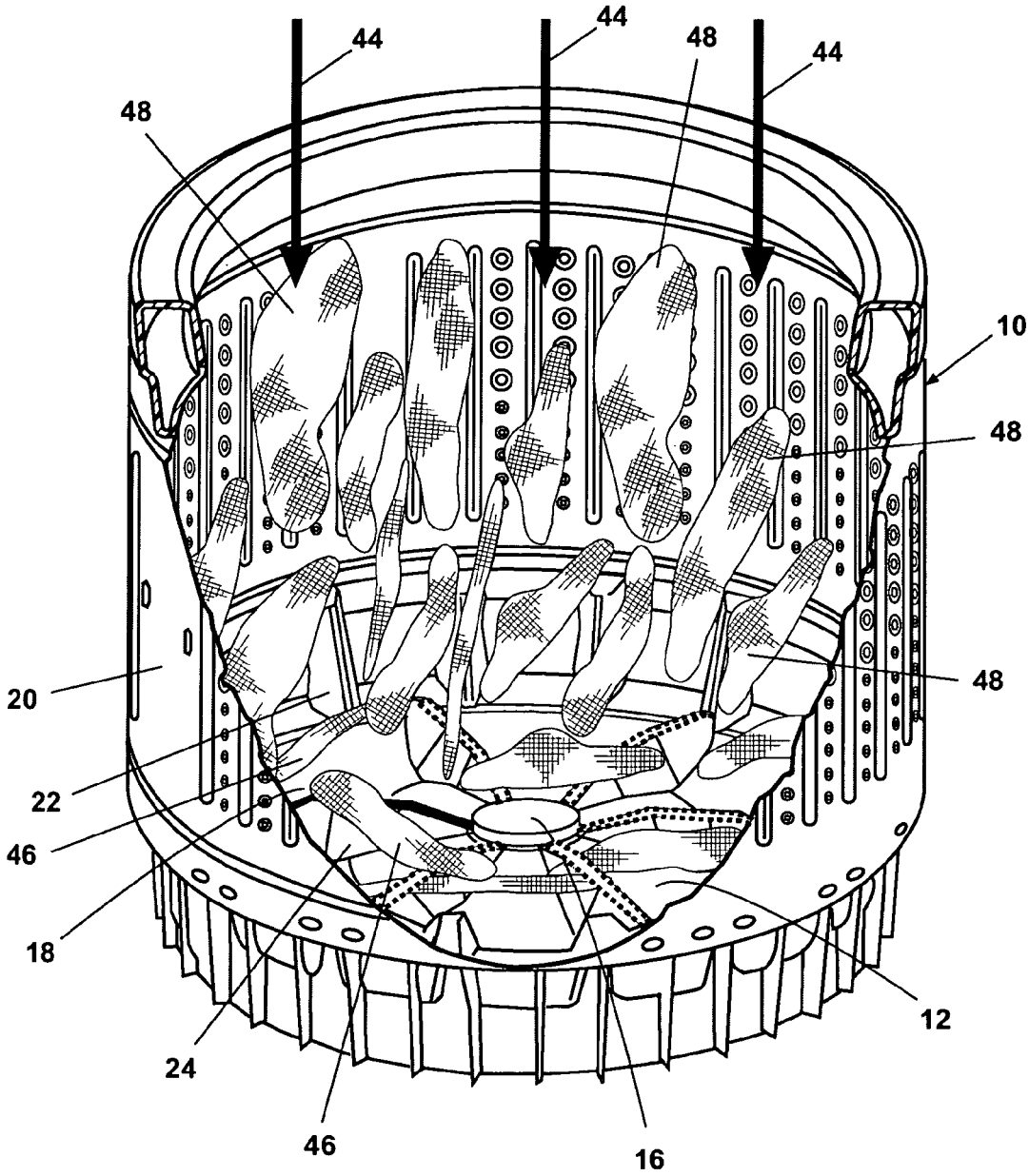
FIG. 17 is a partial cutaway view of the vertical axis wash basket of FIG. 10 illustrating a seventh step in reorienting the garments according to the invention.
Figure 18:
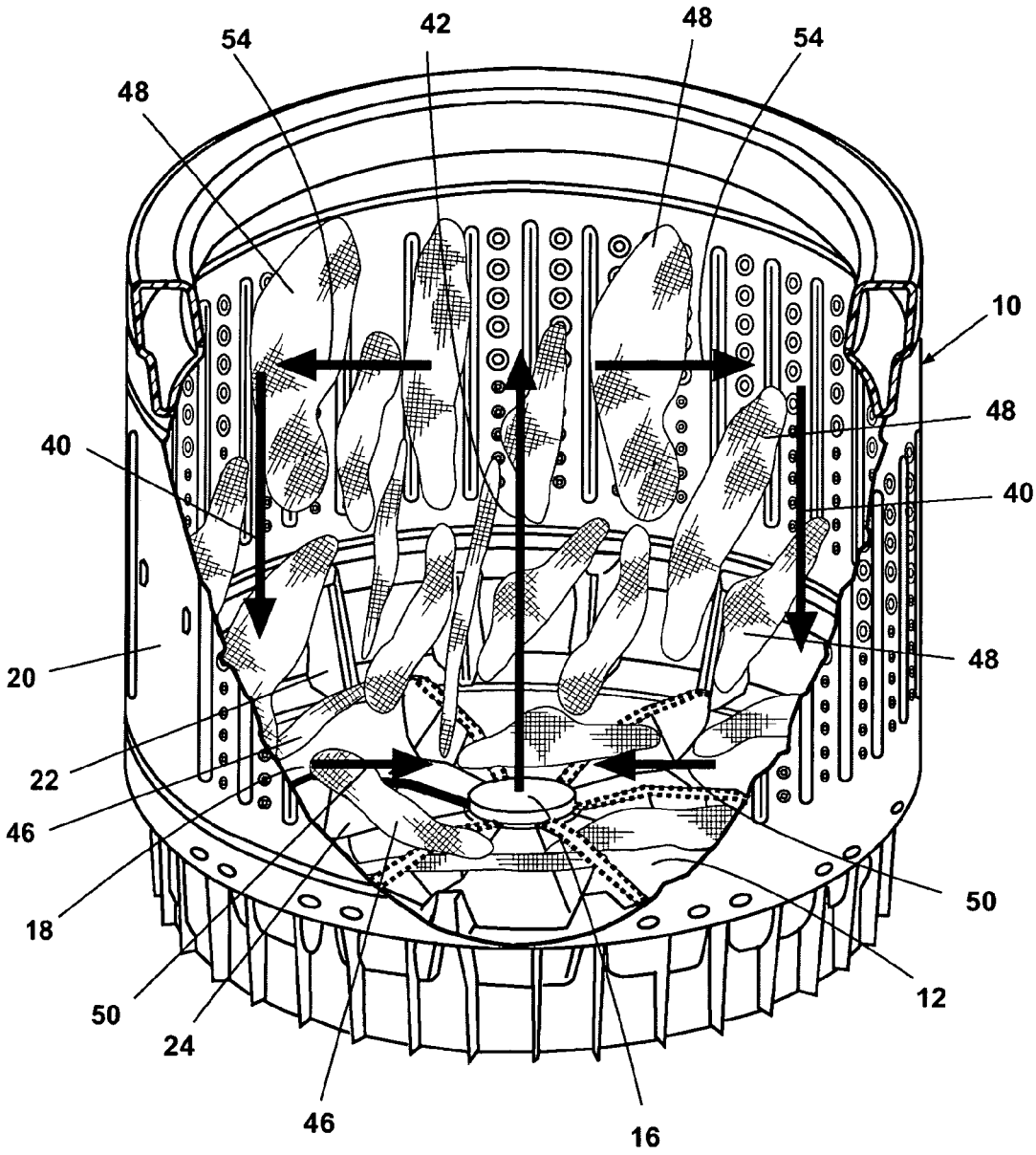
FIG. 18 is a partial cutaway view of the vertical axis wash basket of FIG. 10 illustrating an eighth step in reorienting the garments according to the invention.

As illustrated in FIG. 17, the entire clothes load 26 is then saturated. This can be accomplished by introducing wash liquid onto the clothes load 26 while the load and the wash basket 10 are rotated, by introducing wash liquid to the clothes load 26 sufficient to saturate or submerge the entire load while the clothes load 26 is held stationary, or by introducing wash liquid to the clothes load 26 and initiating oscillation of the impeller 12 to move the garments 28 under the wash liquid inlet stream to saturate or submerge the load 26. The introduction of the wash liquid to the entire clothes load 26 results in an even load being imposed on the impeller 12 and the basket rim 18. The laundering cycle can then continue, with the garments 28 able to move effectively radially toward the center 16 of the impeller 14, as illustrated by the radial displacement vectors 50 in FIG. 18, upward along the axis 14, and radially outward along the top of the clothes load 26 as illustrated by the radial displacement vectors 54, in an inverse toroidal rollover pattern to effectively launder the garments 28. After a period of time, with the entire load 26 moving in an inverse toroidal rollover pattern, the garments will naturally move radially away from the vertical axis 14 along the top of the load 26, opening up a passageway along the axis 14 to enable the garments migrating radially inwardly along the impeller 12 to move upwardly through the clothes load 26.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for washing articles of clothing forming a clothes load in an automatic clothes washer comprising a wash basket defining a wash chamber for receiving a clothes load and a clothes mover provided in the wash chamber for reciprocal rotation, the method comprising:

introducing wash liquid into a pre-selected region of the wash chamber to locally wet only a portion of a clothes load located in the pre-selected region to form a clothes load with both wetted and unwetted articles to define a first volume of wash liquid;

ceasing the introduction of wash liquid upon reaching the first volume of wash liquid;

rotating the clothes mover for reorientation of a clothes load;

introducing wash liquid into the wash chamber sufficient to saturate both the wetted and unwetted articles to define a second volume of wash liquid, wherein the second volume of wash liquid is greater than the first volume of wash liquid; and rotating the clothes mover for washing of a clothes load.

2. A method according to claim 1 and further comprising one of oscillating the clothes mover or spinning the wash basket in order to estimate a dry load weight of the clothes load.

3. A method according to claim 1 wherein the first volume of wash liquid is less than a volume of wash liquid sufficient to completely submerge a clothes load.

4. A method according to claim 1 wherein rotating the clothes mover for reorientation of a clothes load comprises reciprocal rotation of the clothes mover.

5. A method according to claim 4 wherein the clothes mover is an impeller and the rotating the clothes mover for reorientation of a clothes load comprises reciprocal rotation of the impeller.

6. A method according to claim 1 wherein locally wetting only a portion of a clothes load placed in the wash chamber comprises wetting only a portion of the clothes load equal to no more than half of the clothes load placed in the wash chamber.

7. A method according to claim 1 wherein locally wetting a portion of a clothes load placed in the wash chamber comprises wetting a portion of the clothes load equal to no more than one quarter of the clothes load placed in the wash chamber.

8. A method according to claim 1 wherein locally wetting a portion of a clothes load comprises wetting a portion of a clothes load while the clothes load is stationary.

9. A method according to claim 1 wherein locally wetting a portion of a clothes load comprises wetting a portion of a clothes load while the wash basket is stationary.

10. A method according to claim 9 wherein introducing wash liquid into a pre-selected region of the wash chamber comprises introducing wash liquid from a stationary wash liquid inlet.

11. A method according to claim 1 wherein reorienting the clothes load comprises reciprocal rotation of an agitator.

12. A method according to claim 1 wherein reorienting the clothes load comprises reciprocal rotation of an impeller.

13. A method for washing articles of clothing forming a clothes load in an automatic clothes washer comprising a wash basket defining a wash chamber for receiving the clothes load and a clothes mover provided in the wash chamber for reciprocal rotation, the method comprising:

wetting only a portion of the clothes load by introducing wash liquid to form a clothes load with both wetted and unwetted articles of clothing;

ceasing introduction of wash liquid;

reorienting the clothes load by moving at least some of the wetted articles of clothing into at least some of the unwetted articles of clothing; and saturating both the wetted and unwetted articles of clothing after the reorienting of the clothes load.

14. A method according to claim 13 wherein reorienting the clothes load comprises moving the unwetted articles of clothing into a generally vertical orientation.

15. A method according to claim 13 wherein moving the unwetted articles of clothing into a generally vertical orientation comprises moving the wetted articles of clothing under the unwetted articles of clothing.

16. A method according to claim 15 wherein moving the wetted articles of clothing under the unwetted articles of clothing comprises reciprocal rotation of the clothes mover.

17. A method according to claim 16 wherein the clothes mover is an impeller and the moving the wetted articles of clothing under the unwetted articles of clothing comprises reciprocal rotation of an impeller.

18. A method according to claim 13 wherein reorienting the clothes load comprises flipping the unwetted articles of clothing.

19. A method according to claim 13 wherein reorienting the clothes load comprises reorienting horizontally oriented articles of clothing into vertically oriented articles of clothing.

20. A method according to claim 13 wherein wetting only a portion of the clothes load comprises wetting only a portion of the clothes load equal to no more than half of the clothes load.

21. A method according to claim 13 wherein wetting a portion of the clothes load comprises wetting only a portion of the clothes load equal to no more than one quarter of the clothes load.

22. A method according to claim 13 wherein wetting a portion of the clothes load comprises wetting a portion of the clothes load while at least one of the wash basket and the clothes load is stationary.

23. A method according to claim 22 wherein wetting a portion of the clothes load comprises introducing wash liquid into the wash chamber from a stationary wash liquid inlet.

24. A method for washing articles of clothing forming a clothes load in an automatic clothes washer comprising a vertically-oriented wash basket, with an open top, defining a wash chamber for receiving a clothes load and a clothes mover provided in the wash chamber for reciprocal rotation, the method comprising:

introducing wash liquid into a pre-selected region of the wash chamber to wet only those articles located in the pre-selected region to form a clothes load with both wetted and unwetted articles, with the wetted articles in the pre-selected region imposing a higher load on the clothes mover than the unwetted articles to form an uneven load on the clothes mover;

ceasing the introduction of wash liquid;

repositioning the articles by rotating the clothes mover to move at least some of the wetted articles into at least some of the unwetted articles and to move at least some of the unwetted articles upwards in the wash chamber;

introducing wash liquid into the wash chamber sufficient to saturate both the wetted and unwetted articles of clothing to define a second volume of wash liquid; and rotating the clothes mover for washing of a clothes load.

25. The method according to claim 24, wherein the clothes mover has vanes, and repositioning the articles comprises contacting both wetted and unwetted articles with the vanes.

26. The method according to claim 25, wherein the clothes mover is an impeller and repositioning the articles comprises reciprocal rotation of the impeller.

* * * * *

UNITED STATES PATENT AND TRADEMARK OFFICE

CERTIFICATE OF CORRECTION

PATENT NO. : 7,578,019 B2
APPLICATION NO. : 11/228101
DATED : August 25, 2009
INVENTOR(S) : La Belle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 836 days.

Signed and Sealed this

Seventh Day of September, 2010

David J. Kappos

David J. Kappos
*Director of the United States Patent and Trademark Office*